US011097180B1

(12) United States Patent
Taboada

(10) Patent No.: US 11,097,180 B1
(45) Date of Patent: Aug. 24, 2021

(54) BRACES FRIENDLY MOUTH GUARD

(71) Applicant: Ana I. Taboada, Brielle, NJ (US)

(72) Inventor: Ana I. Taboada, Brielle, NJ (US)

( * ) Notice: Subject to any disclaimer, the term of this patent is extended or adjusted under 35 U.S.C. 154(b) by 0 days.

(21) Appl. No.: 17/169,479

(22) Filed: Feb. 7, 2021

Related U.S. Application Data

(63) Continuation of application No. 17/134,453, filed on Dec. 27, 2020.

(51) Int. Cl.
*A63B 71/08* (2006.01)

(52) U.S. Cl.
CPC ..... *A63B 71/085* (2013.01)

(58) Field of Classification Search
CPC ..... A63B 71/085; A63B 2071/086; A63B 2071/088; A61F 5/56; A61F 5/566; A61F 2005/563; A61C 7/08; A61C 7/36; A61C 9/0006
See application file for complete search history.

(56) References Cited

U.S. PATENT DOCUMENTS

| | | | | |
|---|---|---|---|---|
| 7,810,503 | B2 * | 10/2010 | Magnin | A61F 5/566 128/848 |
| 8,448,282 | B2 * | 5/2013 | Stapelbroek | A61C 7/08 15/22.1 |
| 9,486,061 | B1 * | 11/2016 | Rosenberg | A46B 9/045 |
| 2009/0272387 | A1 * | 11/2009 | Spencer | A61F 5/566 128/848 |
| 2013/0074851 | A1 * | 3/2013 | Herman | A63B 71/085 128/861 |
| 2017/0001095 | A1 * | 1/2017 | Lovat | A63B 71/085 |
| 2018/0325721 | A1 * | 11/2018 | Magnin | A61F 5/566 |
| 2019/0046301 | A1 * | 2/2019 | Lovat | A61C 9/0006 |

* cited by examiner

*Primary Examiner* — Camtu T Nguyen

(57) ABSTRACT

A mouth guard that can be used with elastic band in place on braces provided. In one example, a mouth guard for protecting teeth during athletic activities is provided that includes a generally u-shaped base coupled to inner and outer flanges to form a teeth receiving pocket. A first slot is formed through a left side the outer flange and open though a top of the outer flange. A second slot is formed through a right side the outer flange and open though a top of the outer flange.

17 Claims, 9 Drawing Sheets

BRACES FRIENDLY MOUTH GUARD

BACKGROUND OF THE INVENTION

Field of the Invention

Embodiments of the invention generally relate to an athletic mouth guard for protecting teeth during athletic activities.

Background

Mouth guards have been long utilized to protect teeth of athletes when participating in contact sports such as football, hockey, basketball, and lacrosse, among other activities. The typical mouth guard has a U-shaped base with inner and outer flanges that extend upwardly to surround the wearer's upper teeth. Such mouth guards cushion the impact of the upper and lower teeth and protect the teeth in response to jarring action or impact.

Many younger athletes also wear orthodontics, such as braces, to correct bite and tooth alignment. Braces constantly apply pressure to the teeth and/or jaw so that they move slowly to a desired position. Some patients require elastic bands (a.k.a. rubber bands) to apply additional pressure to correct the position of the jaw so that the upper and lower teeth properly align. Bite correction is usually the longest and most difficult part of an orthodontic treatment, generally requiring elastic bands to be worn 12-24 hours per day. Failure to utilize elastic bands will reduce the effectiveness and prolong the need to continue the orthodontic process. As athletes having braces with elastic bands need to remove the elastic bands in order to utilize their mouth guards while playing sports, their braces are cannot function as intended during this period, allowing the jaw to move back to its previous position, and thus unintentionally extending the time required to complete orthodontic process.

Therefore, there is a need for an improved mouth guard that can be worn while utilizing braces having elastic bands.

SUMMARY OF THE INVENTION

A mouth guard that can be used with elastic band in place on braces provided. In one example, a mouth guard for protecting teeth during athletic activities is provided that includes a generally u-shaped base coupled to inner and outer flanges to form a teeth receiving pocket. A first slot is formed through a left side the outer flange and open though a top of the outer flange. A second slot is formed through a right side the outer flange and open though a top of the outer flange.

In another example, a mouth guard is provided that includes a generally u-shaped base coupled to inner and outer flanges to form a teeth receiving pocket. A first slot is formed through a left side the outer flange and open though a top of the outer flange. A second slot is formed through a right side the outer flange and open though a top of the outer flange. A first opening is formed in at least one or both of the outer flange and the base. The first opening is coupled to the first slot and has a width greater than a width of the first slot. A second opening is formed in at least one or both of the outer flange and the base. The second opening is coupled to the second slot and has a width greater than a width of the first slot.

In another example, a mouth guard is provided that includes a generally u-shaped base coupled to inner and outer flanges to form a teeth receiving pocket. A first slot is formed through a left side the outer flange and open though a top of the outer flange. A second slot is formed through a right side the outer flange and open though a top of the outer flange. A first opening is formed in the base and coupled to the first slot. A second opening is formed in the base and coupled to the second slot.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures. It is contemplated that elements and features of one embodiment may be beneficially incorporated in other embodiments without further recitation.

It is to be noted, however, that the appended drawings illustrate only exemplary embodiments of this invention and are therefore not to be considered limiting of its scope, for the invention may admit to other equally effective embodiments.

DETAILED DESCRIPTION

A braces friendly mouth guard is described therein that advantageously allows users to utilize elastic bands with their braces while wearing the mouth guard. The mouth guard is generally configured with a slot in the outer flange that accommodates the elastic band, thus allowing the mouth guard to be inserted into the mouth and worn without having to remove or refasten elastic bands attached to the braces.

Figure 1:
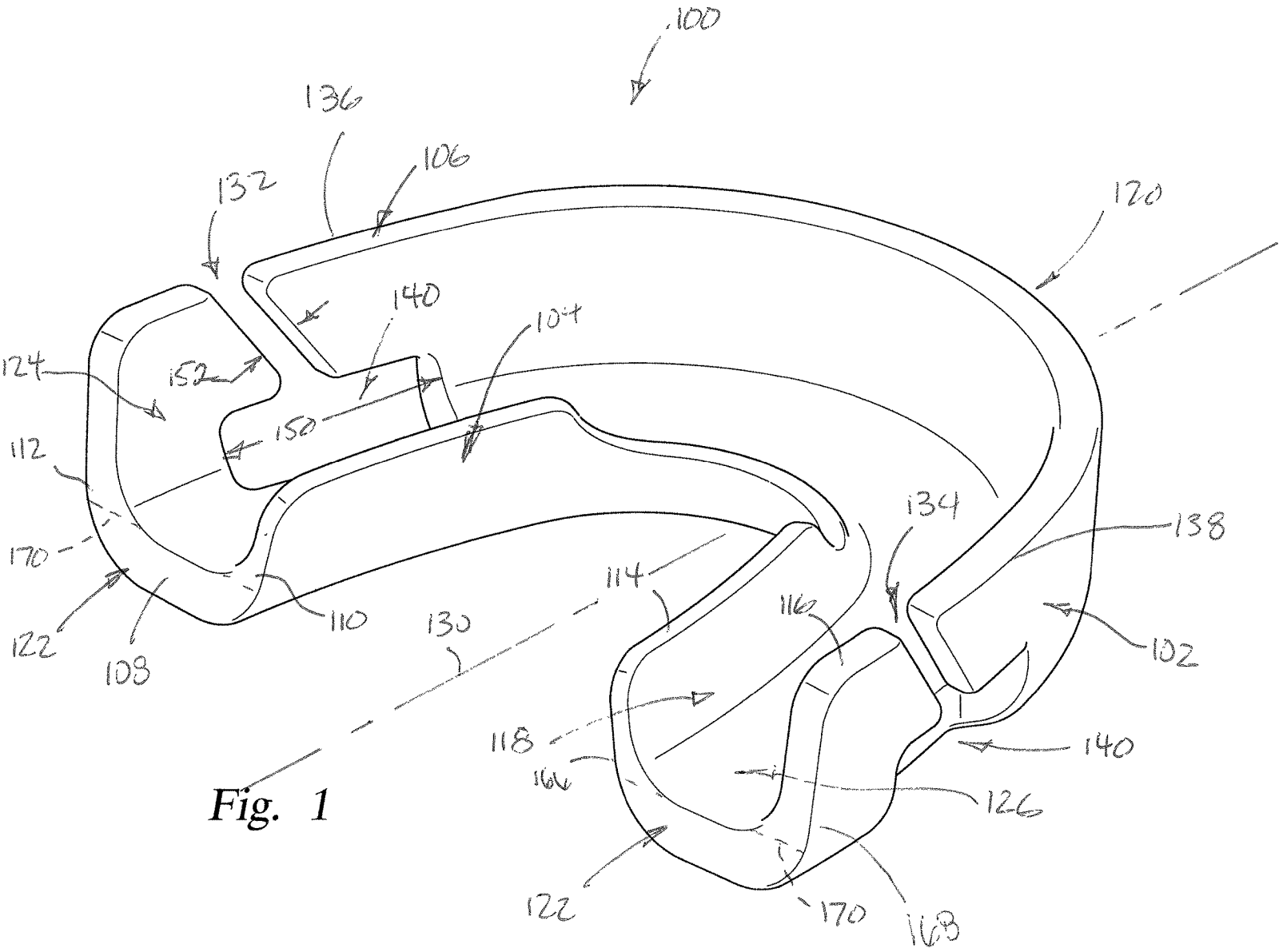
FIG. 1 is an isometric top back view of a mouth guard.
Figure 2:
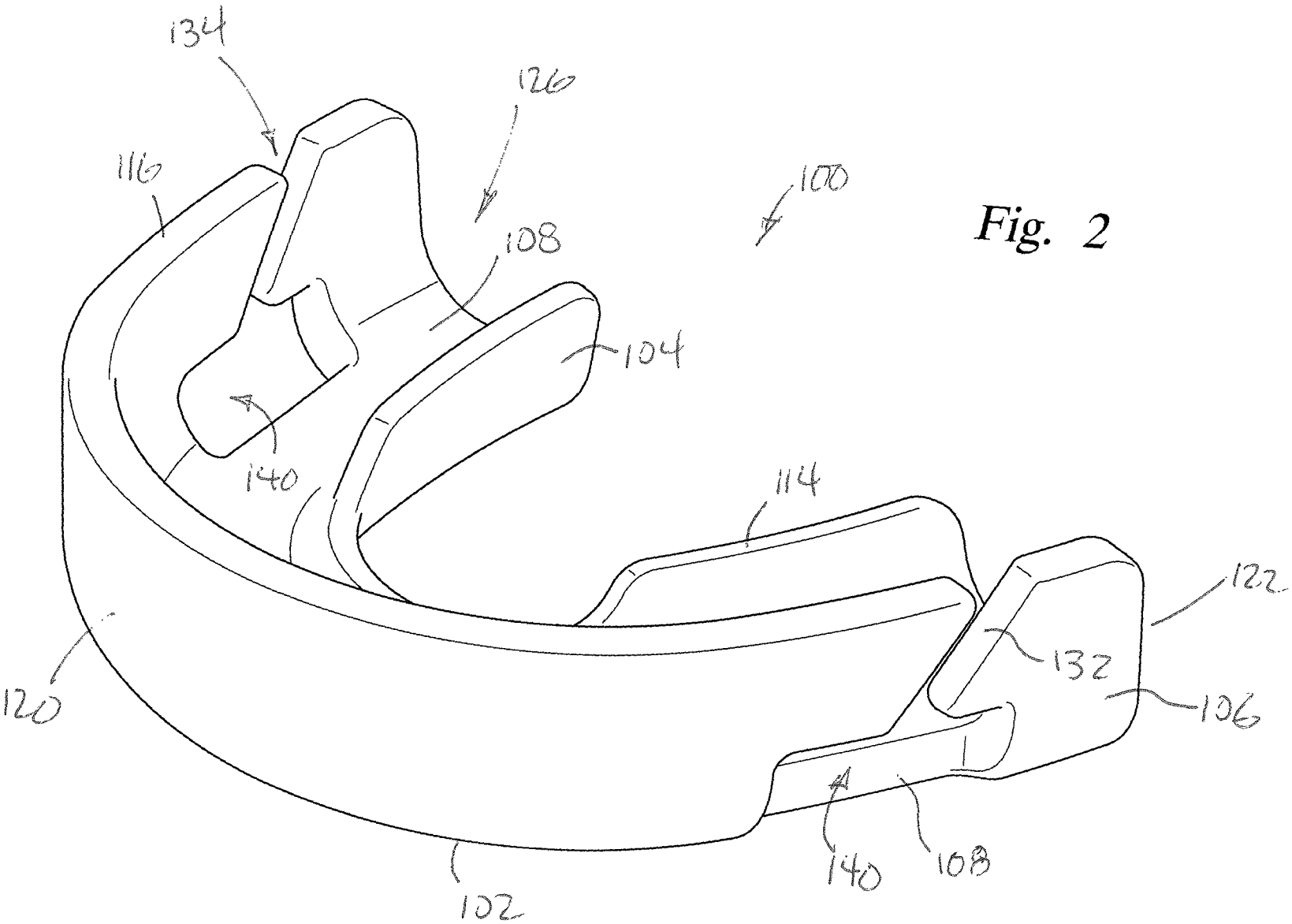
FIG. 2 is an isometric top front view of the mouth guard of FIG. 1.
Figure 3:
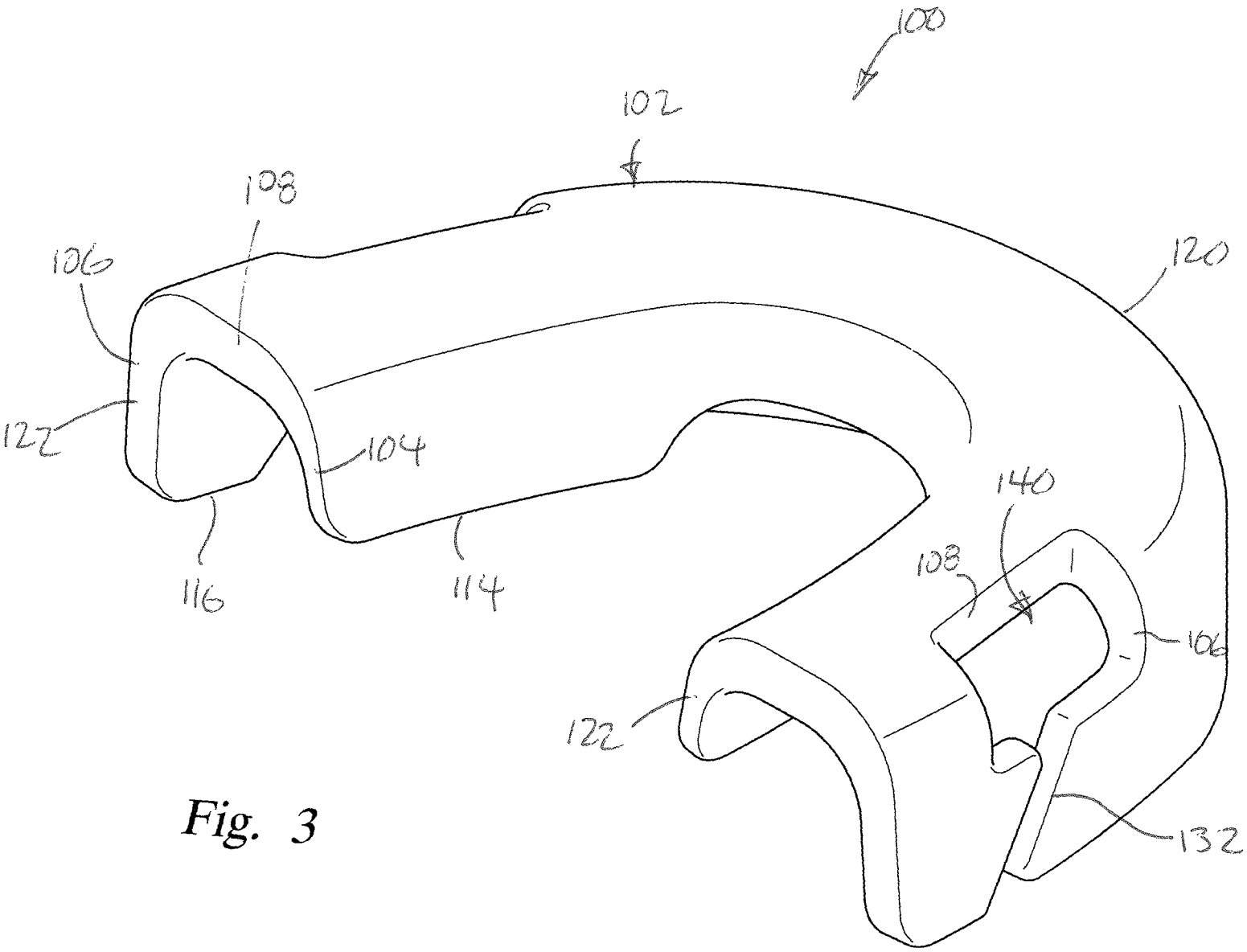
FIG. 3 is an isometric bottom back view of the mouth guard of FIG. 1.
Figure 4:
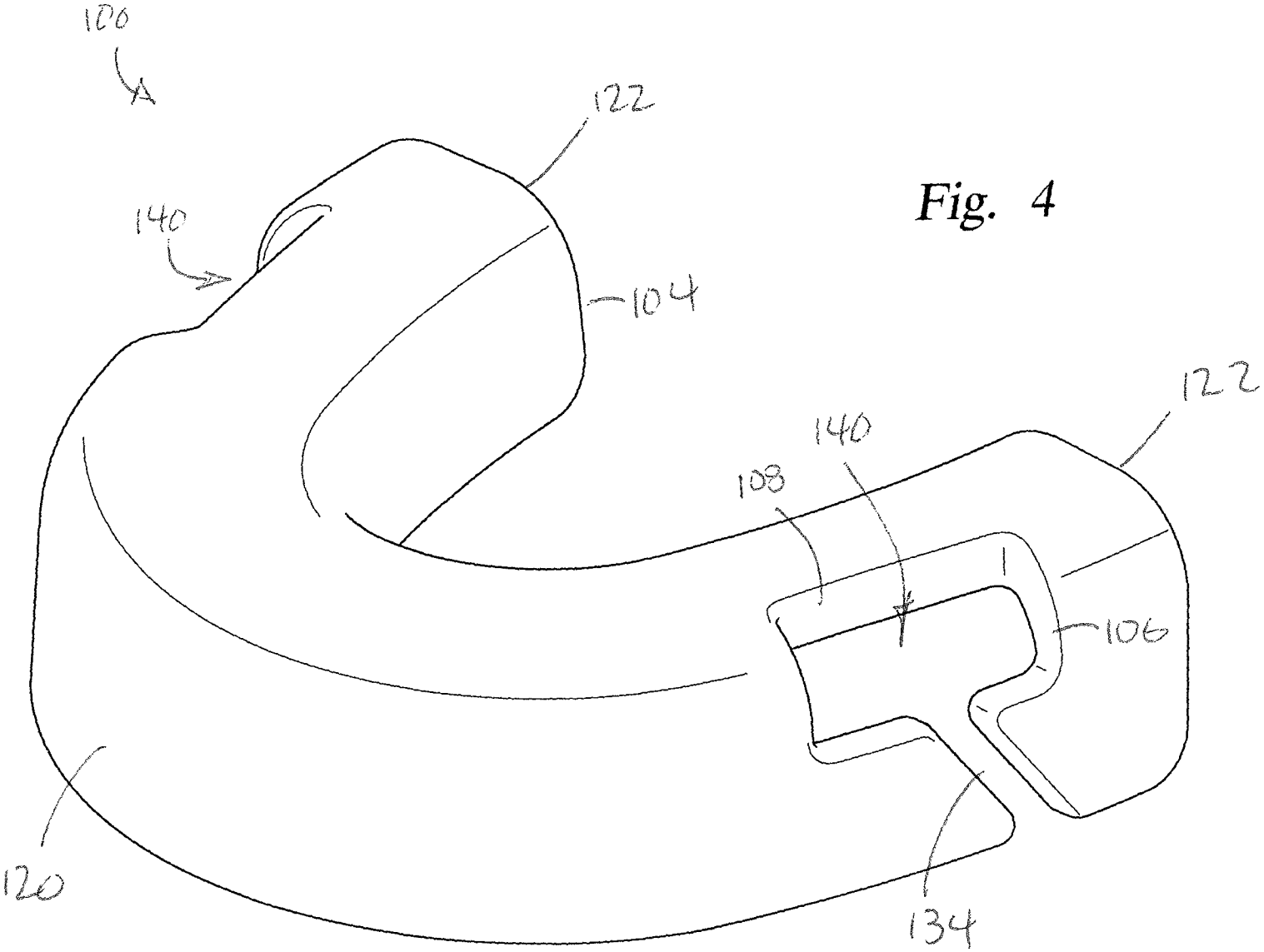
FIG. 4 is an isometric bottom front view of the mouth guard of FIG. 1.
Figure 5:
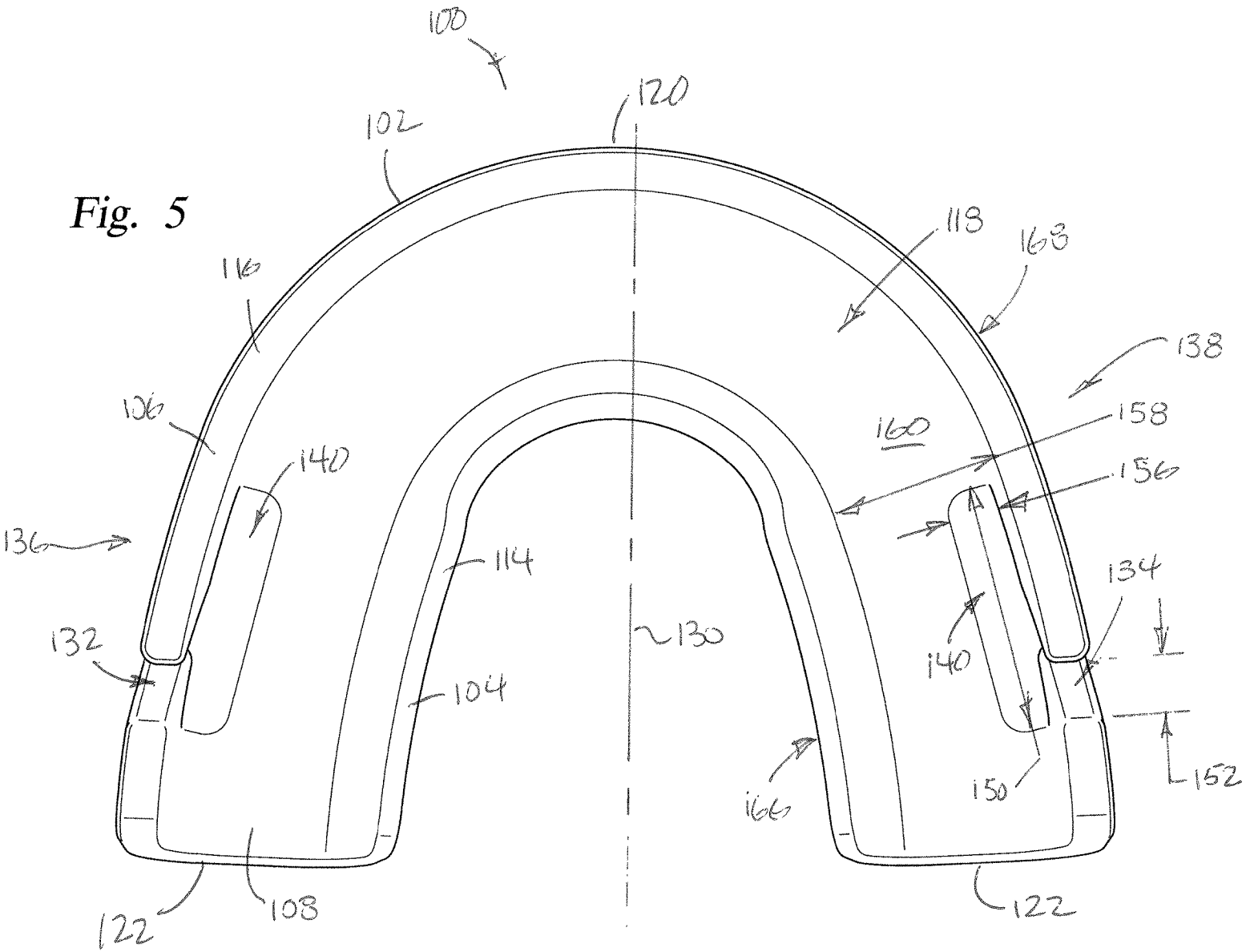
FIG. 5 is a top view of the mouth guard of FIG. 1.
Figure 6:
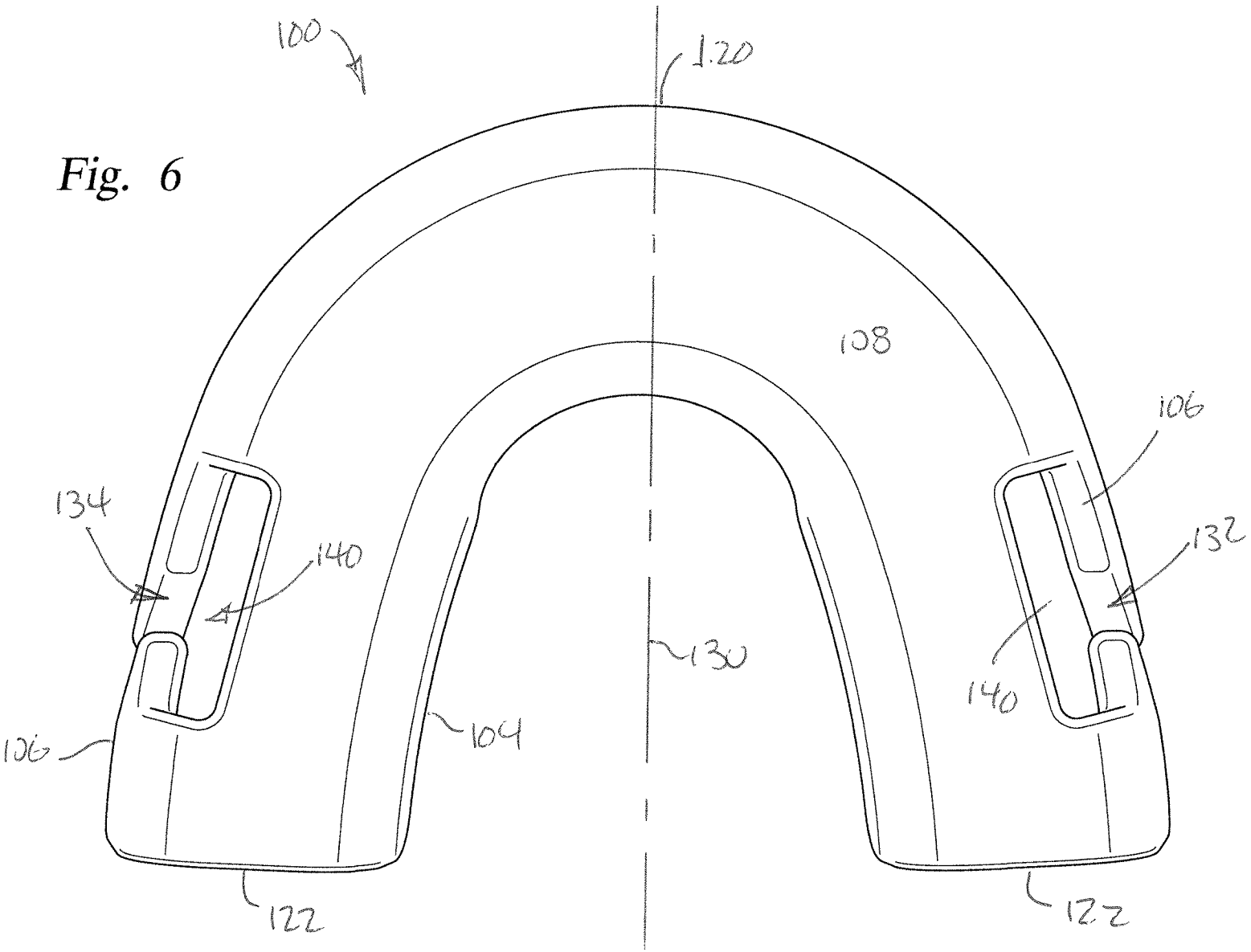
FIG. 6 is a bottom view of the mouth guard of FIG. 1.
Figure 7:
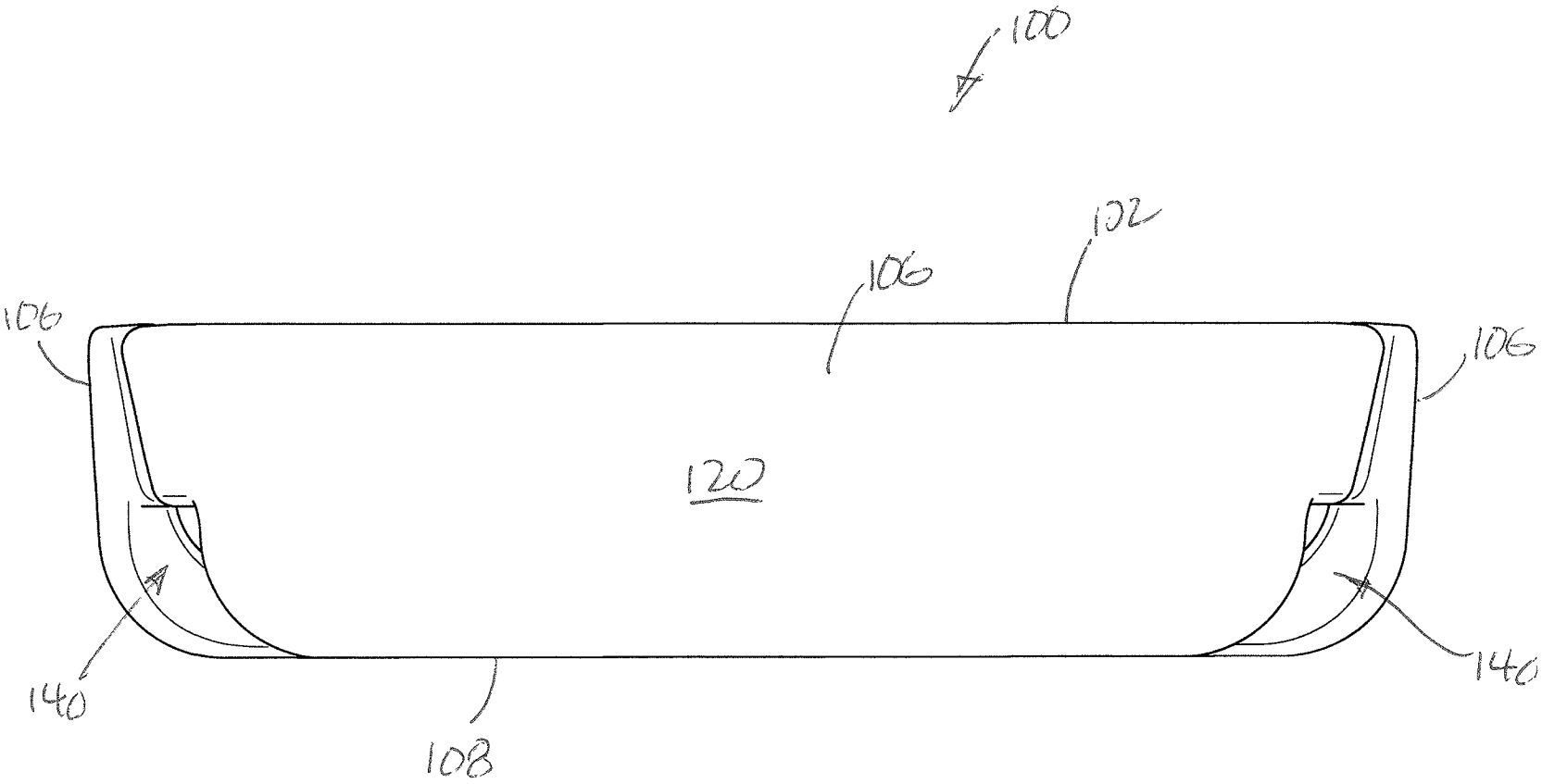
FIG. 7 is a front view of the mouth guard of FIG. 1.
Figure 8:
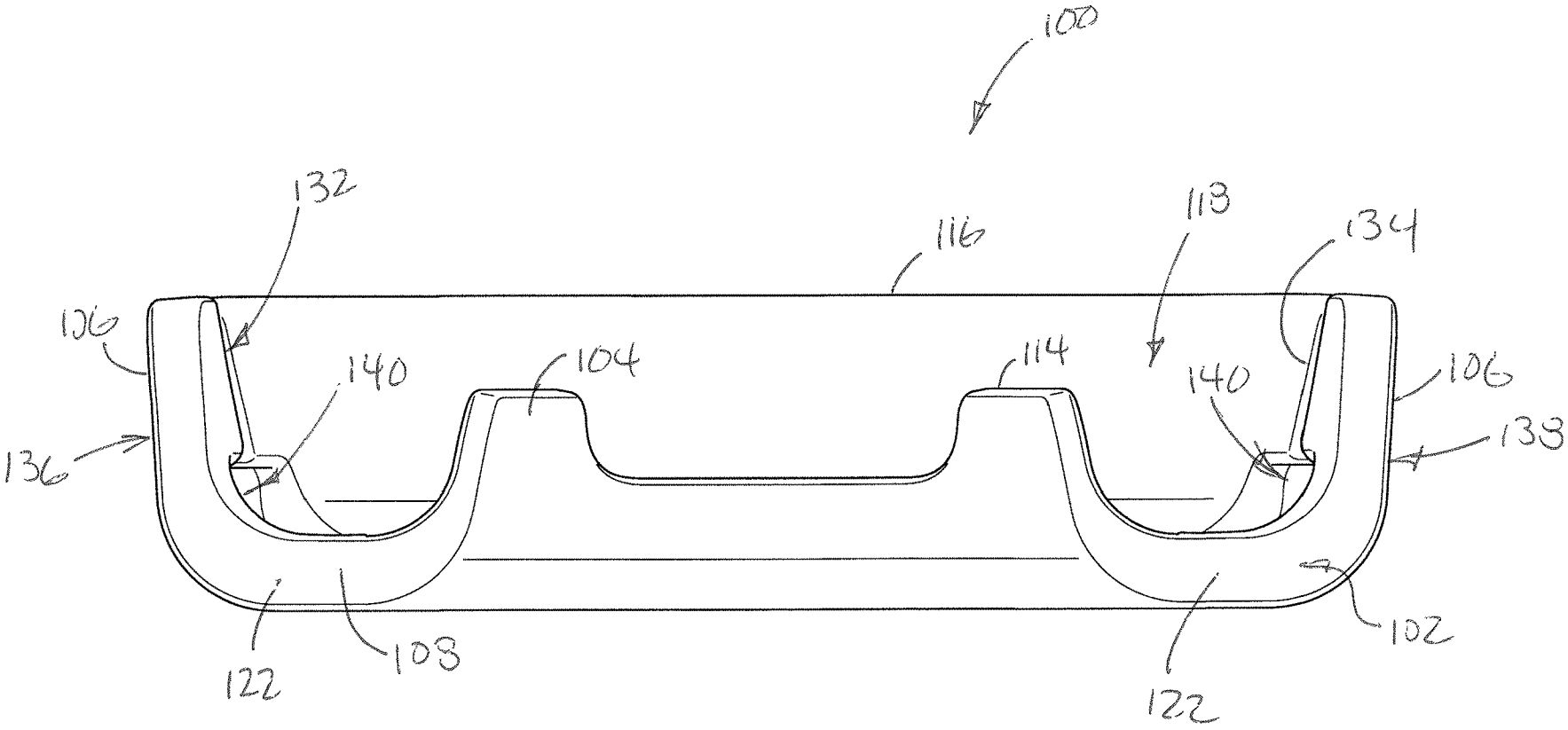
FIG. 8 is a back view of the mouth guard of FIG. 1.

FIG. 1 is an isometric top back view of an athletic mouth guard 100. FIGS. 2-9 provide other views of the mouth guard 100 which can be referred to for additional clarity of the description below. The adjective "athletic" is intended to designate that the mouth guard 100 is configured to be worn during sporting activities to protect the athlete's teeth from jarring or impact. It also also contemplated that the mouth guard 100 may be utilized for other purposes not related to sporting activities or by persons not having braces.

The mouth guard 100 includes a generally u-shaped body 102 sized to fit over the users upper teeth. The body 102 is generally made from one or more polymer materials. In one example, the body 102 is fabricated ethylene vinyl acetate (EVA), silicone, or other suitable polymer. In one example, the material of the body 102 is selected to provide a level of shock and impact resistance suitable for protecting teeth during athletic activities.

The body 102 includes an inner flange 104, an outer flange 106 and a base 108. As described herein, the base 108 extends completely to the inner and outer surfaces 166, 168 of the mouth guard 100, with the flanges 104, 106 transitioning to the base 108 as illustrated by dashed line 170. The inner flange 104 and the outer flange 106 are connected at their respective bottoms 110, 112 to the base 108. Tops 114, 116 of the inner flange 104 and the outer flange 106 extend away from the base 108 to form a u-shaped teeth receiving pocket 118. The outer flange 106 forming the outer wall of the pocket 118 also forms a front 120 of the mouth guard 100. The flanges 104, 106 and base 108 at a rear 122 of the mouth guard 100 form open ends 124, 126 of the pocket 118 which allow the users teeth to extend out the rear 122 of the mouth guard 100.

The outer flange 106 includes at least two slots 132, 134. The first slot 132 is disposed on a left side 136 of the mouth guard 100, while the second slot 134 is disposed on a right side 138 of the mouth guard 100. The left and right sides 136, 138 of the mouth guard 100 demarcated by a centerline 130 extending parallel to a plane of the base 108 extending between the front 120 and the rear 122. The centerline 130 bifurcates the mouth guard 100 into left and right sides 136, 138, as viewed from the rear 122 of the mouth guard 100 with the teeth receiving pocket 118 facing up.

The first slot 132 is formed through the outer flange 106 and is open through the top 116 of the outer flange 106 to allow an elastic band (not shown) to be accommodated in the mouth guard 100. The first slot 132 may have an orientation that is normal to the base 108. Alternatively, the first slot 132 may have an orientation that is slanted downward from the top 116 towards the base 108 and to the rear 122 of the mouth guard 100 (as shown in Alternative Detail A of FIG. 9). In the example depicted in FIG. 1, the first slot 132 has an orientation that is slanted downward from the top 116 towards the base 108 and to the front 120 of the mouth guard 100. When slanted slanted downward from the top 116 towards the base 108 and to the front 120 of the mouth guard 100, an elastic band secured between upper and lower braces (not shown) can easily slide into the slot 132 as the mouth guard 100 is inserted into the mouth of the user, while also allowing the elastic bands to exit the slot 132 as the mouth guard 100 is removed from the mouth of the user.

Optionally, the slot 132 may connect with an opening 140 formed in one or both of the bottom 112 and the base 108 of the mouth guard 100. The opening 140 generally has a width 150 that is greater, for example 2, 3, 4, 5 or more times greater than a width 152 of the slot 132. The width 150 of the slot 132 enables the mouth guard 100 to accommodate a wider variety of elastic band positions. Furthermore, when the opening 140 is formed through the base 108 of the mouth guard 100, the elastic band will have better alignment between the top and bottom teeth, as the mouth guard 100 will have little to no interference with the orientation of the band.

The opening 140 formed through the base 108 generally has a width 150 that is much greater than a depth 156. The depth 156 measured in a direction from the outer flange 106 towards the inner flange 104 and best illustrated in FIG. 5. The depth 156 of opening 140 generally is much less than a distance 158 across a portion 160 of the base 108 exposed between the flanges 104, 106 at the bottom of the pocket 118. For example, the depth 156 is less than half, less than a quarter, or even less than an eighth of the distance 158. In one example, the depth 156 is 2 to 3 times the sectional profile of the elastic band so that the band may freely move within the opening 140. By having the distance 158 across the portion 160 being much greater than the depth 156, the sufficient base material remains between the teeth at the bottom of the pocket 118 so as not to compromise the protective function of the base 108.

The second slot 134 is configured similar to the first slot 132. In the example depicted in FIG. 1, the second slot 134 has an orientation that is a mirror image of the configuration of the first slot 132 relative to the centerline 130.

Figure 9:
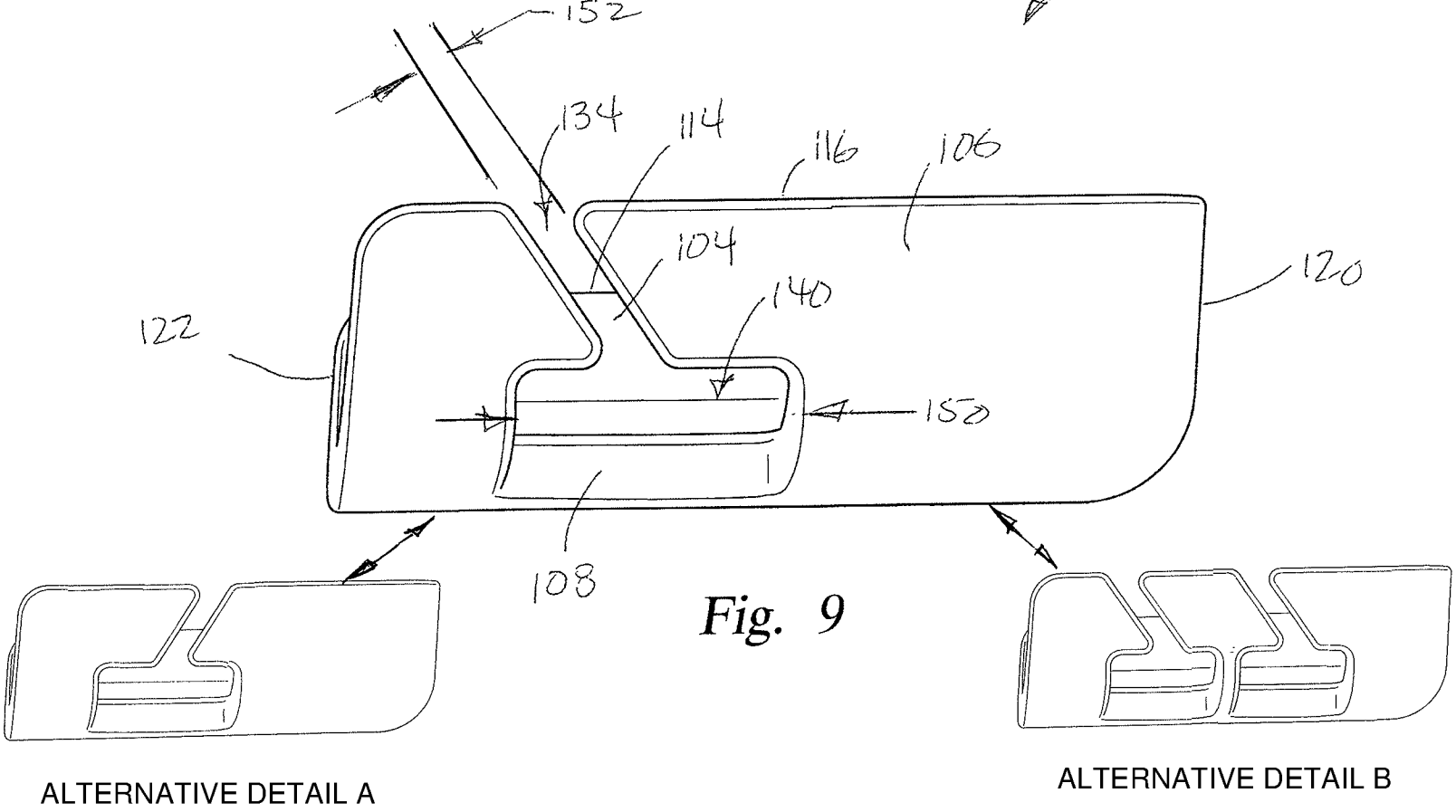
FIG. 9 is a side view of the mouth guard of FIG. 1, the opposite side the mirror image thereof.

Although only two slots 132, 134 are illustrated in the Figures, more than two slots may be utilized (such as a two slots per side as shown in Alternative Detail B in FIG. 9). Additionally, one slot may pass through the centerline 130.

Thus, a mouth guard has been disclose that beneficially can be worn by users with elastic bands present on their braces. Accordingly, the elastic bands do not need to be removed while using a mouth guard while engaging in athletic activities, as with conventional mouth guards. Of course, the protective functionality of the mouth guard is independent from the ability of utilize the mouth guard with elastic bands, and as such, the mouth guard can be utilized by persons without braces.

Although various embodiments which incorporate the teachings of the present invention have been shown and described in detail herein, those skilled in the art can readily devise many other varied embodiment that still incorporate these teachings.

What is claimed is:

1. A mouth guard for protecting teeth during athletic activities, the mouth guard comprising:

a base being u-shaped;

an inner flange coupled to the base;

an outer flange coupled to the base, the base, the inner flange and outer flange forming a teeth receiving pocket having a u-shaped sectional profile;

a first slot formed through a left side the outer flange and open through a top of the outer flange;

a second slot formed through a right side the outer flange and open through a top of the outer flange, wherein the first slot has an orientation that is a mirror image of an orientation of the second slot relative to a centerline of the mouth guard extending from a front to a rear of the mouth guard, the centerline bifurcating the mouth guard into the left and right sides; and a first opening formed in at least one or both of the outer flange and the base, the first opening coupled to the first slot and having a width greater than a width of the first slot.

2. The mouth guard of claim 1, wherein the width of the first opening is at least 2 time greater than the width of the first slot.

3. The mouth guard of claim 2, wherein the first opening extend into a portion of the base exposed between the inner and outer flanges.

4. The mouth guard of claim 3, wherein a depth of the first opening extending into the portion of the base exposed between the inner and outer flanges is less than half a distance between the inner and outer flanges across the exposed portion of the base.

5. The mouth guard of claim 1, wherein the width of the first opening is at least 4 time greater than the width of the first slot.

6. The mouth guard of claim 1, wherein the first slot has an orientation that is normal to a plane of the base.

7. The mouth guard of claim 1, wherein the first slot has an orientation that is slanted downward from the top of the outer flange towards the base and a rear of the mouth guard.

8. The mouth guard of claim 1, wherein the first slot has an orientation that is slanted downward from the top of the outer flange towards the base and a front of the mouth guard.

9. The mouth guard of claim 1 comprising:

a third slot formed through outer flange and open through though a top of the outer flange.

10. A mouth guard for protecting teeth during athletic activities, the mouth guard comprising:

a base being u-shaped;

an inner flange coupled to the base;

an outer flange coupled to the base, the base, the inner flange and outer flange forming a teeth receiving pocket having a u-shaped sectional profile;

a first slot formed through a left side the outer flange and open through a top of the outer flange;

a second slot formed through a right side the outer flange and open through a top of the outer flange, the second slot being a mirror image of the first slot;

a first opening formed in the base, the first opening coupled to the first slot and having a width greater than a width of the first slot; and a second opening formed in the base, the second opening coupled to the second slot and having a width greater than a width of the second slot.

11. The mouth guard of claim 10, wherein the first and second openings extend into a portion of the base exposed between the inner and outer flanges.

12. The mouth guard of claim 10, wherein the first and second slots have orientations that are slanted downward from the top of the outer flange towards the base, and slanted downward from the top of the outer flange toward the rear or front of the mouth guard.

13. A mouth guard for protecting teeth during athletic activities, the mouth guard comprising:

a base being u-shaped;

an inner flange coupled to the base;

an outer flange coupled to the base, the base, the inner flange and outer flange forming a teeth receiving pocket having a u-shaped sectional profile;

a first slot formed through a left side the outer flange and open through a top of the outer flange;

a second slot formed through a right side of the outer flange and open through a top of the outer flange, wherein the first slot has an orientation that is a mirror image of an orientation of the second slot relative to a centerline of the mouth guard extending from a front to a rear of the mouth guard, the centerline bifurcating the mouth guard into the left and right sides;

a first opening formed in at least one or both of the outer flange and the base, the first opening coupled to the first slot and having a width greater than a width of the first slot; and a second opening formed in at least one or both of the outer flange and the base, the second opening coupled to the second slot and having a width greater than a width of the first slot.

14. The mouth guard of claim 13, wherein the first and second openings extend into a portion of the base exposed between the inner and outer flanges.

15. The mouth guard of claim 14, wherein the first slot has an orientation that is normal to a plane of the base.

16. The mouth guard of claim 14, wherein the first slot has an orientation that is slanted downward from the top of the outer flange towards the base, and slanted downward from the top of the outer flange towards the rear or front of the mouth guard.

17. The mouth guard of claim 14 comprising:

a third slot formed through outer flange and open through the top of the outer flange.

* * * * *